United States Patent [19]

Koda et al.

[11] Patent Number: 4,963,108

[45] Date of Patent: Oct. 16, 1990

[54] MARINE CONTRA-ROTATING PROPELLER DRIVE SYSTEM

[75] Inventors: Masatoshi Koda; Kazuyuki Araki, both of Nagasaki, Japan

[73] Assignee: Mitsubishi Jukogyo Kabushiki Kaisha, Tokyo, Japan

[21] Appl. No.: 442,985

[22] Filed: Nov. 28, 1989

[30] Foreign Application Priority Data

Nov. 30, 1988 [JP] Japan ..... 63-303769

[51] Int. Cl.[5] ..... B63H 23/24

[52] U.S. Cl. ..... 440/81; 244/60; 416/129

[58] Field of Search ..... 440/81, 83; 244/60, 244/69; 416/124–129, 170; 74/421 R, 412 R, 413, 665 A, 665 B

[56] References Cited

U.S. PATENT DOCUMENTS 2,480,806 8/1949 Desmoulins ..... 416/129

FOREIGN PATENT DOCUMENTS 0139790 6/1987 Japan ..... 440/81

2165024 4/1986 United Kingdom ..... 416/129 R

*Primary Examiner*—Joseph F. Peters, Jr.

*Assistant Examiner*—Ed Swinehart

*Attorney, Agent, or Firm*—Wenderoth, Lind & Ponack

[57] ABSTRACT

A marine contra-rotating propeller system comprises a large gear driven by an engine, and a plurality of small gears disposed so as to respectively mesh with the large gear at a plurality of fixed positions along the circumference of the large gear. Planet gears are respectively mounted to the gear shafts of the small gears. A sun gear and an inner-toothed gear are respectively meshed with the planet gears. A rear propeller is mounted to an inner shaft serving as a gear shaft of the sun gear. A front propeller is mounted to a tubular outer shaft serving as a gear shaft of the inner-toothed gear. The present invention can eliminate, with the simple construction, the inconvenience caused by a differential planetary gear operations in the prior art, can derive a propeller efficiency to the maximum extent.

3 Claims, 2 Drawing Sheets

MARINE CONTRA-ROTATING PROPELLER DRIVE SYSTEM

BACKGROUND OF THE INVENTION

1. Field of the Invention:

The present invention relates to a marine contra-rotating propeller drive system, and more particularly to a marine contra-rotating propeller drive system which reduces a speed of rotation of an engine and transmits it to two propellers disposed on a same axis.

2. Description of the Prior Art:

In a propelling system of a ship, in the case where an engine serving as a main engine and two propellers are disposed on a same axis and inner and outer double shafts for driving these propellers are both reduced in speed, normally an epicyclic gear is employed.

As shown in a schematic longitudinal cross-section view of FIG. 4 and in a schematic view taken along line V—V in FIG. 4 as viewed in the direction of arrows of FIG. 5, heretofore, such an epicyclic gear is constructed as a reversing mechanism 2' for reversing rotation of a main engine 1' and transmitting it to the respective propellers.

The reversing mechanism 2' is composed of a sun gear 2B' connected to a main output shaft 7' of the main engine 1', planet gears 2C' meshed with the outer circumference of the sun gear 2B' and rotatably supported via bearings 2D' from a carrier that is integrally connected to an inner shaft 3C' of a rear propeller 6C', and an inner-toothed gear 2A' having its inner circumference meshed with the outer circumferences of the planet gears 2C' and mounted to a front propeller 6A'. In FIG. 4, reference numeral 5' designates bearings for the inner shaft 3C' and an outer shaft 3A'.

In the reversing mechanism 2' constructed in the above-described manner, a torque generated by the main engine 1' is transmitted to the sun gear 2B' connected to the output shaft 7'. Accompanying the rotation of the sun gear 2B', the planet gear 2C' revolves around the sun gear 2B' while rotating on its own axis. Due to these rotation and revolution of the planet gears 2C', the outer shaft 3A' is rotated via the inner-toothed gear 2A' in the opposite direction to the input shaft 7' of the reversing mechanism 2', that is, the output shaft 7' of the main engine 1', and thereby it drives the front propeller 6A'.

On the other hand, the inner shaft 3C' rotatably supporting the planet gears 2C' rotates in the same direction as the input shaft 7' and drives the rear propeller 6C'.

Through the aforementioned operations, the two propellers are driven in the opposite directions to each other, and moreover, at a lower rotational speed than that of the main engine 1'.

However, the marine contra-rotating propeller drive system in the prior art as described above, involves the following technical problems to be resolved:

(1) The planet gears 2C' connected to the rear propeller 6C' and the inner-toothed gear 2A' connected to the front propeller 6A' form a differential gear mechanism because they both rotate about a common axis, hence if a load upon one of the propellers is changed due to an external force, then the rotational speed of the other propeller also varies, thus the rotational speeds of the two propellers would be determined by the both propeller loads, and so, it would become impossible to operate the propellers at optimum speeds.

(2) In the case where the differential planetary rotation is controlled so as to rotate at any arbitrary rotational speeds, contrivances such as providing a brake device at the outer shaft 3A', regulating the revolving speed of the planet gears by means of a hydraulic motor (See Laid-Open Japanese Patent Specification No. 59-96092) or the like, would become necessary, hence the structure would be complicated, and maneuverability of the system would be also deteriorated.

(3) Since the planet gear 2C' revolves, it is extremely difficult to provide a thrust bearing for supporting a thrust acting upon the inner shaft 3C'.

In order to drive at reduced speeds the inner and outer shafts on the same axis while avoiding the aforementioned problems, if parallel-shaft gears are used, then large gears aligned in three or more rows would be necessitated, hence the reversing mechanism would become large-sized, and so, the system would become disadvantageous in view of arrangement and cost.

As another method, it is also possible to make the main engine and the propellers have different axes and to reduce the speed by means of parallel-shaft gears, but in this case also, the system is not favorable in view of arrangement and cost.

SUMMARY OF THE INVENTION

It is a principal object of the present invention to provide a marine contra-rotating propeller drive system which is free from the above-mentioned shortcomings of such drive systems in the prior art.

A more specific object of the present invention is to provide a marine contra-rotating propeller drive system, which does not use a large-sized reversing mechanism, but in which upon reducing a rotational speed of a contra-rotating propeller with respect to a rotational speed of an engine, variation of a relative rotational speed between the two propellers would not be caused even by change of loading upon the propellers.

According to one feature of the present invention, in order to achieve the aforementioned objects, there is provided a marine contra-rotating propeller drive system comprising a large gear driven by an engine, a plurality of small gears disposed so as to respectively mesh with the large gear at a plurality of fixed positions in the circumferential portion of the large gear, a plurality of planet gears respectively mounted to the gear shafts of the small gears, a sun gear and an inner-toothed gear respectively meshed with the planet gears, a rear propeller being mounted to an inner shaft serving as a gear shaft of the sun gear, and a front propeller being mounted to a tubular outer shaft serving as a gear shaft of the innertoothed gear.

In operation of the marine contra-rotating propeller drive system according to the present invention, as a result of rotation of an engine, a large gear is rotated, and as a result of rotation of small gears caused by rotation of the large gear, planet gears rotate. Then, rotation of the planet gears, on one hand rotates a sun gear in the same direction as the large gear, and on the other hand rotates an inner-toothed gear in the opposite direction.

During the above-mentioned operation, the small gears and the planet gears connected with each other via gear shafts do not revolve around but rotate on their own axes because the positions of the respective gear shafts are constrained. Accordingly, the sun gear connected to the rear propeller would rotate in the same direction as the large gear. In addition, the inner-toothed gear connected to the front propeller would rotate in the opposite direction to the large gear.

In this way, the two propellers are driven at reduced rotational speeds with respect to that of the engine by the combination of the respective gears.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Figure 1:
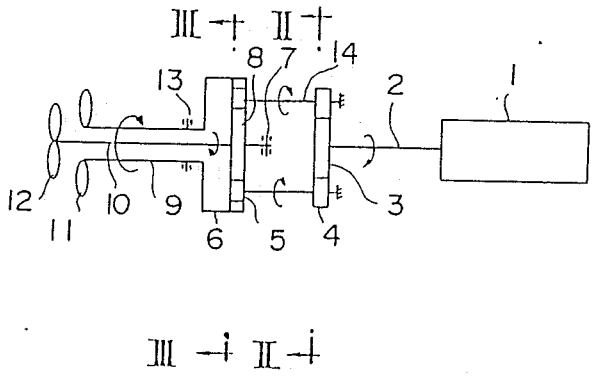
FIG. 1 is a schematic longitudinal cross-section view showing a marine contra-rotating propeller drive system according to one preferred embodiment of the present invention.
Figure 2:
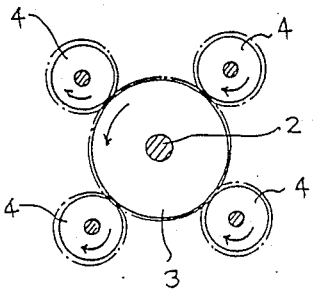
FIG. 2 is a schematic transverse cross-section view taken along line II—II in FIG. 1 as viewed in the direction of arrows.
Figure 3:
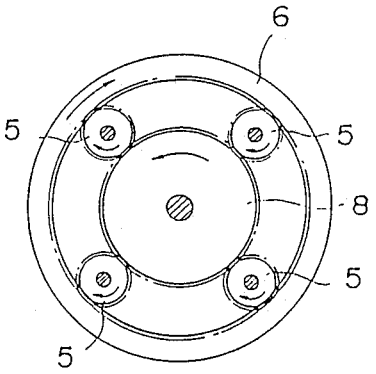
FIG. 3 is another schematic transverse cross-section view taken along line III—III in FIG. 1 as viewed in the direction of arrows.
Figure 4:
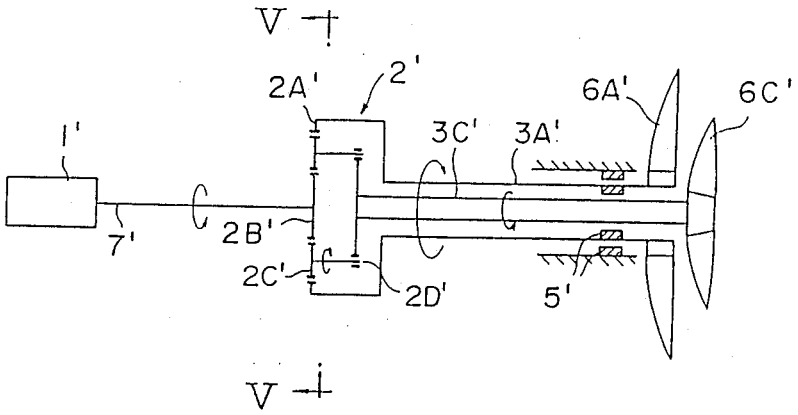
Fig. 4 (Prior Art)
FIG. 4 is a schematic longitudinal cross-section view showing a marine contra-rotating propeller drive system in the prior art.
Figure 5:
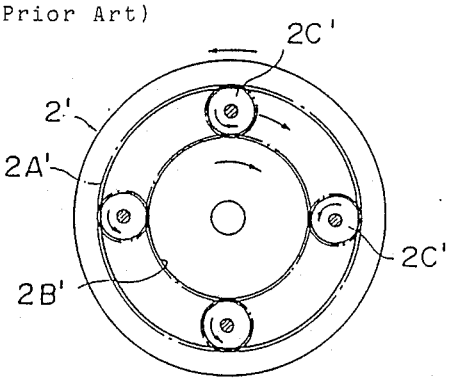
Fig. 5 (Prior Art)
FIG. 5 is a schematic transverse cross-section view taken along line V—V in FIG. 4 as viewed in the direction of arrows.

Referring now to FIGS. 1 to 3, which illustrate a marine contra-rotating propeller drive system according to one preferred embodiment of the present invention, the marine contra-rotating propeller drive system is provided with a large gear 3 connected to an output shaft 2 of an engine serving as a main engine 1 to be driven thereby, and four small gears 4 rotatably supported from a hull or the like at four fixed positions in the circumferential portion of the large gear 3 and disposed so as to respectively mesh with the large gear 3.

To gear shafts 14 of these respective small gears 4 are respectively mounted planet gears 5, and a sun gear 8 and an inner-toothed gear 6 are disposed to be meshed with these planet gears 5 at their outer and inner circumferences, respectively.

In addition, a rear propeller 12 is mounted to an inner shaft 10 serving as a gear shaft of the sun gear 8, and a front propeller 11 is mounted to a tubular outer shaft 9 serving as a gear shaft of the inner-toothed gear 6.

It is to be noted that reference numeral 7 designates an inner shaft thrust bearing provided at the portion of the inner shaft 10 projecting from the sun gear 8 in the opposite direction to the rear propeller 12, and numeral 13 designates an outer shaft thrust bearing.

In the marine contra-rotating propeller drive system constructed in the above-described manner, as shown in FIG. 2 rotation of the main engine 1 causes the large gear 3 to rotate via the output shaft 2, and as a result of rotation of the gear shafts 14 caused by the rotation of the large gear 3, the planet gears 5 rotate as shown in FIG. 3.

Then, rotation of the planet gears 5, on one hand, causes the sun gear 8 to rotate in the same direction as the output shaft 2 and the large gear 3, and on the other hand causes the inner-toothed gear 6 in the opposite direction.

During such operations, the small gears 4 and the planet gears 5 interconnected by the gear shafts 14 do not revolve around but rotate on their own axes because the positions of the gear shafts 14 are constrained as shown in FIG. 1. Accordingly, the sun gear 8 connected to the rear propeller 12 rotates in the same direction as the large gear 3 as shown in FIG. 3.

In addition, the inner-toothed gear 6 connected to the front propeller 11 rotates in the opposite direction to the large gear 3 as shown in FIG. 3.

In this way, the two propellers are driven at a reduced rotational speed as compared to that of the main engine 1 by means of the combination of the respective gears 3–8.

As described in detail above, with the subject marine contra-rotating propeller drive system, inconvenience caused by a differential planetary operation as is the case where planet gears were used in the reversing mechanism 2' in the prior art as well as disadvantages in arrangement and cost caused by large-sizing of the system as in the case where parallel-shaft gears were used, can be eliminated, and a small-sized less expensive drive shaft system is provided.

In addition, since both the inner shaft 10 and the outer shaft 9 are reduced in speed, design of propellers for deriving a propeller efficiency at the maximum extent without being constrained by a rating rotational speed or the like of the main engine 1, becomes possible, the system is very advantageous in view of energy saving, also the range of selection for a rotational speed of the engine 1 is broadened, and practical use of the system is improved.

Furthermore, owing to the fact that the gear shafts 14 and the planet gears 5 do not revolve around, arrangement of the thrust bearing 7 for the inner shaft 10 is very simple, also since the front end surface of the inner shaft 10 is exposed, an oil feed device for a rotary joint or the like in the case of feeding oil to the center of the inner shaft 10 can be easily mounted, and so, it becomes possible to achieve simplification in the aspect of lubrication.

Moreover, since there exists a rotational speed difference between the inner shaft and the outer shaft (different-speed reversing), improvements in a performance of the inner shaft bearing can be achieved owing to a squeeze effect of that bearing.

As described in detail above, with the marine contra-rotating propeller drive system according to the present invention, the following effects and advantages are obtained:

(1) In convenience caused by a differential planetary operation as in the case where planet gears were used in the reversing mechanism in the prior art as well as disadvantages in arrangement and cost caused by large-sizing of the system as in the case where parallel-shaft gears were use, can be eliminated, and a small-sized less expensive drive shaft system is provided.

(2) Since both the inner shaft and the outer shaft are reduced in speed, design of propellers for deriving a propeller efficiency to the maximum extent without being constrained by a rating rotational speed or the like of the main engine, becomes possible, the system is very advantageous in view of energy saving, also the range of selection for a rotational speed of the engine is broadened, and practical use of the system is improved.

(3) Owing to the fact that the gear shafts and the planet gears do not revolve around, arrangement of the thrust bearing for the inner shaft is very simple, also since the front end surface of the inner shaft is exposed, an oil feed device for a rotary joint or the like in the case of feeding oil to the center of the inner shaft can be easily mounted, and so, it becomes possible to achieve simplification in the aspect of lubrication.

(4) Since the inner shaft and the outer shaft are reversed in rotation at different speeds, improvements in a performance of the inner shaft bearing can be achieved.

While the present invention has been described in detail in connection to one preferred embodiment of the invention, the present invention should not be limited to the above-described embodiment, but various changes and modifications can be made for embodiment without departing from the scope of the invention, and especially it is a matter of arbitrary choice how many planet gears are provided and whether the large gear is designed as an inner-toothed gear or an outer-toothed gear to be meshed with the small gears.

What is claimed is:

1. A marine contra-rotating propeller drive system comprising a large gear driven by an engine, a plurality of small gears disposed so as to respectively mesh with said large gear at a plurality of fixed positions about a circumferential portion of said large gear, a plurality of planet gears respectively mounted to gear shafts of said small gears, a sun gear and an inner-toothed gear respectively meshed with said planet gears, a rear propeller being mounted to an inner shaft serving as a gear shaft of said sun gear, and a front propeller being mounted to a tubular outer shaft serving as a gear shaft of said inner-toothed gear.

2. A marine contra-rotating propeller drive system as claimed in claim 1, wherein said plurality of small gears are rotatably supported from a hull.

3. A marine contra-rotating propeller drive system as claimed in claim 1, wherein an inner shaft thrust bearing is provided at a portion of said inner shaft serving as the gear shaft of said sun gear, said inner shaft portion projecting from said sun gear in the opposite direction to the rear propeller.

* * * * *